US009708158B2

(12) United States Patent
Kakio et al.

(10) Patent No.: US 9,708,158 B2
(45) Date of Patent: Jul. 18, 2017

(54) MULTI-CAR ELEVATOR USING AN EXCLUSION ZONE AND PREVENTING INTER-CAR COLLISION

(75) Inventors: Masayuki Kakio, Tokyo (JP); Takuo Kugiya, Tokyo (JP); Kiyoshi Funai, Tokyo (JP); Eiji Ando, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 420 days.

(21) Appl. No.: 14/380,206

(22) PCT Filed: Apr. 16, 2012

(86) PCT No.: PCT/JP2012/060245

§ 371 (c)(1),
(2), (4) Date: Aug. 21, 2014

(87) PCT Pub. No.: WO2013/157070

PCT Pub. Date: Oct. 24, 2013

(65) Prior Publication Data

US 2015/0291390 A1 Oct. 15, 2015

(51) Int. Cl.

| | |
|---|---|
| ***B66B 9/00*** | (2006.01) |
| ***B66B 5/02*** | (2006.01) |
| ***B66B 5/00*** | (2006.01) |

(52) U.S. Cl.

CPC ..... *B66B 5/02* (2013.01); *B66B 5/0031* (2013.01); *B66B 9/00* (2013.01)

(58) Field of Classification Search

CPC ..... B66B 5/02; B66B 5/0031; B66B 9/00
USPC ..... 187/247, 249, 288, 293, 296, 297, 391, 187/393, 394

See application file for complete search history.

(56) References Cited

U.S. PATENT DOCUMENTS 5,482,143 A * 1/1996 Saito ..... B66B 1/2433 187/292
5,663,538 A * 9/1997 Sakita ..... B66B 1/2466 187/249

(Continued)

FOREIGN PATENT DOCUMENTS

JP 56-012281 A 2/1981
JP 9-194162 7/1997

(Continued)

OTHER PUBLICATIONS

Office Action issued Oct. 6, 2015 in Japanese Patent Application No. 2014-510984 (with English translation).

(Continued)

*Primary Examiner* — Anthony Salata
(74) *Attorney, Agent, or Firm* — Oblon, McClelland, Maier & Neustadt, L.L.P.

(57) ABSTRACT

In a multi-car elevator, if two vertically adjacent cars among the cars are designated first and second cars, then: a zone that is a distance in which the second car can be stopped in response to an abnormality, and into which the first car is not permitted to enter is set as an exclusion zone of the second car; a position before which it is necessary for the first car to stop is set as a stopping limit position of the first car; and a plurality of threshold values that progressively detect the abnormal approach are set so as to enable the first car to decelerate and stop before the stopping limit position of the first car.

5 Claims, 9 Drawing Sheets

(56) References Cited

U.S. PATENT DOCUMENTS

| | | | | |
|---|---|---|---|---|
| 5,877,462 | A * | 3/1999 | Chenais | B66B 5/0031 187/249 |
| 7,487,860 | B2 * | 2/2009 | Hikita | B66B 1/2433 187/249 |
| 7,819,228 | B2 * | 10/2010 | Terry | B66B 5/0031 187/249 |
| 7,917,341 | B2 * | 3/2011 | Sansevero | B66B 1/2466 187/247 |
| 8,136,635 | B2 * | 3/2012 | Christy | B66B 5/0031 187/249 |
| 8,434,599 | B2 * | 5/2013 | Wang | B66B 5/0031 187/249 |
| 8,739,936 | B2 * | 6/2014 | Kostka | B66B 1/2433 187/249 |
| 9,010,499 | B2 * | 4/2015 | McCarthy | B66B 1/3492 187/249 |
| 9,394,139 | B2 * | 7/2016 | Kugiya | B66B 1/32 |
| 2005/0279584 | A1 * | 12/2005 | Reuter | B66B 5/0031 187/249 |
| 2008/0060882 | A1 | 3/2008 | Nuebling | |

FOREIGN PATENT DOCUMENTS

| | | | |
|---|---|---|---|
| JP | 2003-081542 | A | 3/2003 |
| JP | 2008-531436 | A | 8/2008 |

OTHER PUBLICATIONS

International Search Report issued Jun. 19, 2012 in PCT/JP2012/060245 filed Apr. 16, 2012.

* cited by examiner

MULTI-CAR ELEVATOR USING AN EXCLUSION ZONE AND PREVENTING INTER-CAR COLLISION

TECHNICAL FIELD

The present invention relates to a multi-car elevator in which a plurality of cars are disposed inside a shared hoistway.

BACKGROUND ART

In conventional multi-car elevators, a speed of a first car, a distance from the first car to a second car, and a danger distance and a minimum distance that depend on the speed of the first car are calculated. Then, if the distance to the second car is less than or equal to the danger distance, the first car is made to perform an emergency stop using a safety device. If the distance to the second car is less than or equal to the minimum distance, an emergency safety device of the first car is activated. In addition, the danger distance is set based on an emergency stop operating curve, and the minimum distance is set based on an operating curve of the emergency safety device (see Patent Literature 1, for example).

In other conventional multi-car elevators, first and second overspeed references relating to a first car are decided based on a relative position of a second car relative to the first car. A relative speed of the first car relative to the second car is detected, and the relative speed and the first and second overspeed references are compared. A hoisting machine brake is activated if the relative speed exceeds the first overspeed reference, and an emergency safety device is activated if the relative speed exceeds the second overspeed reference (see Patent Literature 2, for example).

CITATION LIST

Patent Literature

[Patent Literature 1]
Japanese Patent Publication No. 2008-531436 (Gazette)
[Patent Literature 2]
Japanese Patent Laid-Open No. 2009-256109 (Gazette)

SUMMARY OF THE INVENTION

Problem to be Solved by the Invention

In the elevator that is disclosed in Patent Literature 1, if stopping is chosen according to a running deceleration curve, then it is necessary to detect an abnormality at a large inter-car distance to decelerate the car, leading to reductions in service.

In the elevator that is disclosed in Patent Literature 2, an algorithm is constructed using relative position and relative speed between the first and second cars. For this reason, that technique can be used when the first and second cars are moving toward each other, but it is necessary to stop one of the cars if they are moving in identical directions, leading to problems in service performance.

The present invention aims to solve the above problems and an object of the present invention is to provide a multi-car elevator that can prevent collisions between cars more reliably by a simple configuration while preventing reductions in serviceability.

Means for Solving the Problem

In order to achieve the above object, according to one aspect of the present invention, there is provided a multi-car elevator including: a plurality of cars that are disposed inside a shared hoistway; a plurality of control portions that control operation of corresponding cars; and an inter-car collision preventing safety device that is connected to the control portions, and that monitors for an abnormal approach between the cars, wherein, if two vertically adjacent cars among the cars are designated first and second cars, then: a zone that is a distance in which the second car can be stopped in response to an abnormality, and into which the first car is not permitted to enter is set as an exclusion zone of the second car; a position before which it is necessary for the first car to stop is set as a stopping limit position of the first car; and a plurality of threshold values that progressively detect the abnormal approach are set so as to enable the first car to decelerate and stop before the stopping limit position of the first car.

Effects of the Invention

A multi-car elevator according to the present invention can prevent collisions between cars more reliably by a simple configuration while preventing reductions in serviceability.

DESCRIPTION OF EMBODIMENTS

Embodiments for implementing the present invention will now be explained with reference to the drawings.

Embodiment 1

Figure 1:
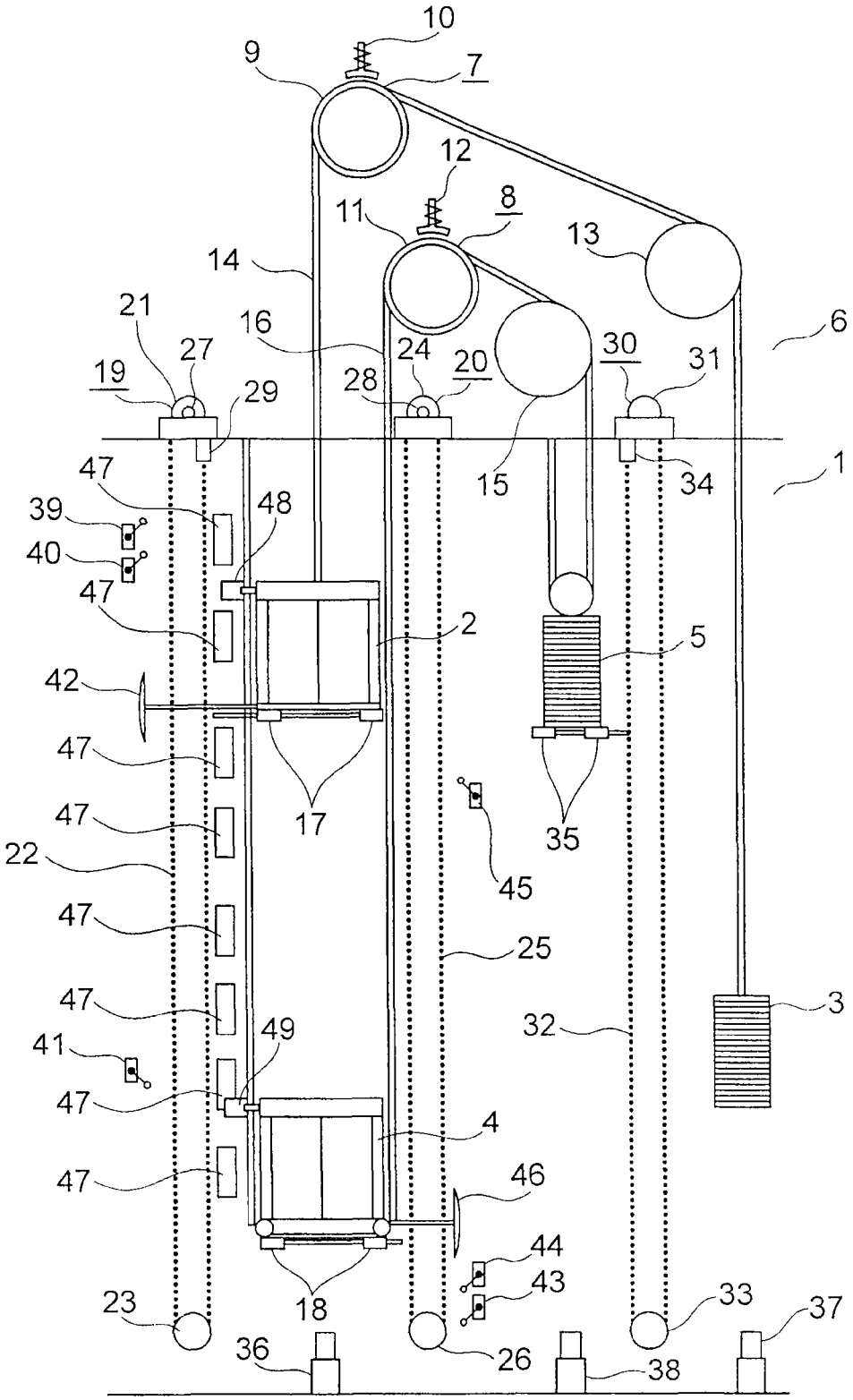
FIG. 1 is a configuration diagram that shows a multi-car elevator according to Embodiment 1 of the present invention.

FIG. 1 is a configuration diagram that shows a multi-car elevator according to Embodiment 1 of the present invention. In the figure, disposed inside a shared hoistway 1 are: a first car (an upper car) 2; a first counterweight 3 that corresponds to the first car 2; a second car (a lower car) 4; and a second counterweight 5 that corresponds to the second car 4. The first car 2 is disposed above (directly above) the second car 4.

A machine room 6 is disposed in an upper portion of the hoistway 1. A first hoisting machine 7 that raises and lowers the first car 2 and the first counterweight 3 and a second hoisting machine 8 that raises and lowers the second car 4 and the second counterweight 5 are installed in the machine room 6. The first and second cars 2 and 4 are raised and lowered inside the hoistway 1 independently from each other by the hoisting machines 7 and 8.

Installed inside the hoistway 1 are: a pair of car guide rails (not shown) that guide raising and lowering of the first and second cars 2 and 4; a pair of first counterweight guide rails (not shown) that guide raising and lowering of the first counterweight 3; and a pair of second counterweight guide rails (not shown) that guide raising and lowering of the second counterweight 5.

The first hoisting machine 7 has: a first driving sheave 9; a first motor (not shown) that rotates the first driving sheave 9; and a first hoisting machine brake 10 that is a braking apparatus that brakes rotation of the first driving sheave 9.

The second hoisting machine 8 has: a second driving sheave 11; a second motor (not shown) that rotates the second driving sheave 11; and a second hoisting machine brake 12 that is a braking apparatus that brakes rotation of the second driving sheave 11.

A first suspending body 14 is wound around the first driving sheave 9 and a first deflecting sheave 13. The first car 2 and the first counterweight 3 are suspended inside the hoistway 1 by the first suspending body 14. A second suspending body 16 is wound around the second driving sheave 11 and the second deflecting sheave 15. The second car 4 and the second counterweight 5 are suspended inside the hoistway 1 by the second suspending body 16.

A plurality of ropes or a plurality of belts, for example, can be used as the first suspending body 14. In this example, the first car 2 and the first counterweight 3 are suspended using a one-to-one (1:1) roping method.

A plurality of ropes or a plurality of belts, for example, can be used as the second suspending body 16. In this example, the second car 4 and the second counterweight 5 are suspended using a two-to-one (2:1) roping method.

A first car emergency safety device 17 that engages mechanically with a car guide rail to make the first car 2 perform an emergency stop is mounted onto the first car 2. A second car emergency safety device 13 that is a braking apparatus that engages mechanically with a car guide rail to make the second car 4 perform an emergency stop is mounted onto the second car 4.

Installed in the machine room 6 are: a first car speed governor 19 that detects overspeeding of the first car 2; and a second car speed governor 20 that detects overspeeding of the second car 4.

The first car speed governor 19 has a first speed governor sheave 21. An endless first speed governor rope 22 is wound around the first speed governor sheave 21. A first tensioning sheave 23 that applies tension to the first speed governor rope 22 is disposed in a lower portion of the hoistway 1.

A portion of the first speed governor rope 22 is connected to the first car 2. The first speed governor rope 22 is thereby moved cyclically together with the hoisting of the first car 2, and the first speed governor sheave 21 is rotated at a speed that corresponds to a velocity of the first car 2.

The second car speed governor 20 has a second speed governor sheave 24. An endless second speed governor rope 25 is wound around the second speed governor sheave 24. A second tensioning sheave 26 that applies tension to the second speed governor rope 25 is disposed in a lower portion of the hoistway 1.

A portion of the second speed governor rope 25 is connected to the second car 4. The second speed governor rope 25 is thereby moved cyclically together with the hoisting of the second car 4, and the second speed governor sheave 24 is rotated at a speed that corresponds to a velocity of the second car 4.

A first encoder 27 that functions as a first speed detector that generates a signal that corresponds to the rotation of the first speed governor sheave 21 is disposed on the first car speed governor 19. A second encoder 28 that functions as a second speed detector that generates a signal that corresponds to the rotation of the second speed governor sheave 24 is disposed on the second car speed governor 20. Incremental rotary encoders are used as the first and second encoders 27 and 28.

The first car speed governor 19 grips the first speed governor rope 22 mechanically if the rotational speed of the first speed governor sheave 21 exceeds a preset speed. A car speed governor rope gripping apparatus 29 that grips the first speed governor rope 22 in compliance with an electrical command signal from outside is disposed on the first car speed governor 19.

If the first car 2 descends when the first speed governor rope 22 is gripped, the first car emergency safety device 17 is activated to make the first car 2 perform an emergency stop. The first car 2 is thereby prevented from traveling at excessive speed during descent. Descent of the first car 2 can also be stopped discretionally by supplying the electrical command signal to the car speed governor rope gripping apparatus 29.

The second car speed governor 20 grips the second speed governor rope 25 mechanically if the rotational speed of the second speed governor sheave 24 exceeds a preset speed.

If the second car 4 descends when the second speed governor rope 25 is gripped, the second car emergency safety device 18 is activated to make the second car 4 perform an emergency stop. The second car 4 is thereby prevented from traveling at excessive speed during descent.

A counterweight speed governor 30 is also installed in the machine room 6. The counterweight speed governor 30 has a counterweight speed governor sheave 31. An endless counterweight speed governor rope 32 is wound around the counterweight speed governor sheave 31. A counterweight speed governor rope tensioning sheave 33 that applies tension to the counterweight speed governor rope 32 is disposed in a lower portion of the hoistway 1.

A portion of the counterweight speed governor rope 32 is connected to the second counterweight 5. The counterweight speed governor rope 32 is thereby moved cyclically together with the hoisting of the second counterweight 5, and the counterweight speed governor sheave 31 is rotated at a speed that corresponds to a velocity of the second counterweight 5.

The counterweight speed governor 30 grips the counterweight speed governor rope 32 mechanically if the rotational speed of the counterweight speed governor sheave 31 exceeds a preset speed. A counterweight speed governor rope gripping apparatus 34 that grips the counterweight speed governor rope 32 in compliance with an electrical command signal from outside is disposed on the counterweight speed governor 30.

A second counterweight emergency safety device 35 that is a braking apparatus that engages mechanically with a second counterweight guide rail to make the second counterweight 5 perform an emergency stop is mounted onto the second counterweight 5.

If the second counterweight 5 descends when the counterweight speed governor rope 32 is gripped, the second counterweight emergency safety device 35 is activated to make the second counterweight 5 perform an emergency stop. The second counterweight 5 is thereby prevented from traveling at excessive speed during descent. Descent of the second counterweight 5 can also be stopped discretionally by supplying the electrical command signal to the counterweight speed governor rope gripping apparatus 34.

In other words, the second car 4, which corresponds to the second counterweight 5, is prevented from traveling at excessive speed during ascent. Ascent of the second car 4 can also be stopped discretionally.

Moreover, a car speed governor that has a construction that can stop the car traveling at excessive speed during ascent and an emergency safety device that has a construction that is also effective during ascent may be used in combination instead of the counterweight speed governor 30 and the counterweight emergency safety device 35.

A car buffer 36, a first counterweight buffer 37, and a second counterweight buffer 38 are installed in a lower portion (a pit floor) of the hoistway 1. The car buffer 36 prevents the second car 4 from colliding with the pit floor and generating an intense mechanical shock if the second car 4 goes beyond a lowermost floor due to some abnormality.

The first counterweight buffer 37 prevents the first car 2 from colliding with a top portion of the hoistway 1 if the first car 2 goes beyond an uppermost floor. A height at the top portion of the hoistway 1 is designed so as to allow for bouncing of the first car 2 if the first counterweight 3 collides with the first counterweight buffer 37.

The second counterweight buffer 38 prevents the second car 4 from colliding with hoistway equipment or with equipment that relates to the first car 2 if the second car 4 goes beyond the highest floor among the floors that the second car 4 serves.

First and second upper portion hoistway switches 39 and 40 are disposed in a vicinity of an upper terminal floor inside the hoistway 1. A lower portion service floor switch 41 is disposed inside the hoistway 1 in a vicinity of the lowest floor among the floors that the first car 2 serves.

A first actuating member (a switch driving rail) 42 that actuates the first and second upper portion hoistway switches 39 and 40 and the lower portion service floor switch 41 is disposed on the first car 2. The upper portion hoistway switches 39 and 40 and the lower portion service floor switch 41 are normally closed switches that each open a circuit when actuated by the first actuating member 42.

The upper portion hoistway switches 39 and 40 enter an open state by being actuated by the first actuating member 42 when the first car 2 stops at the uppermost floor. The lower portion service floor switch 41 enters an open state by being actuated by the first actuating member 42 when the first car 2 stops at the lowest floor among the floors that the first car 2 serves.

First and second lower portion hoistway switches 43 and 44 are disposed in a vicinity of an lower terminal floor inside the hoistway 1. An upper portion service floor switch 45 is disposed inside the hoistway 1 in a vicinity of the highest floor among the floors that the second car 4 serves.

A second actuating member (a switch driving rail) 46 that actuates the first and second lower portion hoistway switches 43 and 44 and the upper portion service floor switch 45 is disposed on the second car 4. The lower portion hoistway switches 43 and 44 and the upper portion service floor switch 45 are normally closed switches that each open a circuit when actuated by the second actuating member 46.

The lower portion hoistway switches 43 and 44 enter an open state by being actuated by the second actuating member 46 when the second car 4 stops at the lowermost floor. The upper portion service floor switch 45 enters an open state by being actuated by the second actuating member 46 when the second car 4 stops at the highest floor among the floors that the second car 4 serves.

In addition, floor alignment plates 47 are respectively disposed at positions that correspond to a plurality of service floors inside the hoistway 1. A first floor alignment sensor 48 that detects the floor alignment plates 47 is mounted on the first car 2. The first floor alignment sensor 48 detects that the first car 2 is positioned within a door zone that enables safe opening and closing of doors.

A second floor alignment sensor 49 that detects the floor alignment plates 47 is mounted on the second car 4. The second floor alignment sensor 49 detects that the second car 4 is positioned within a door zone that enables safe opening and closing of doors.

Figure 2:
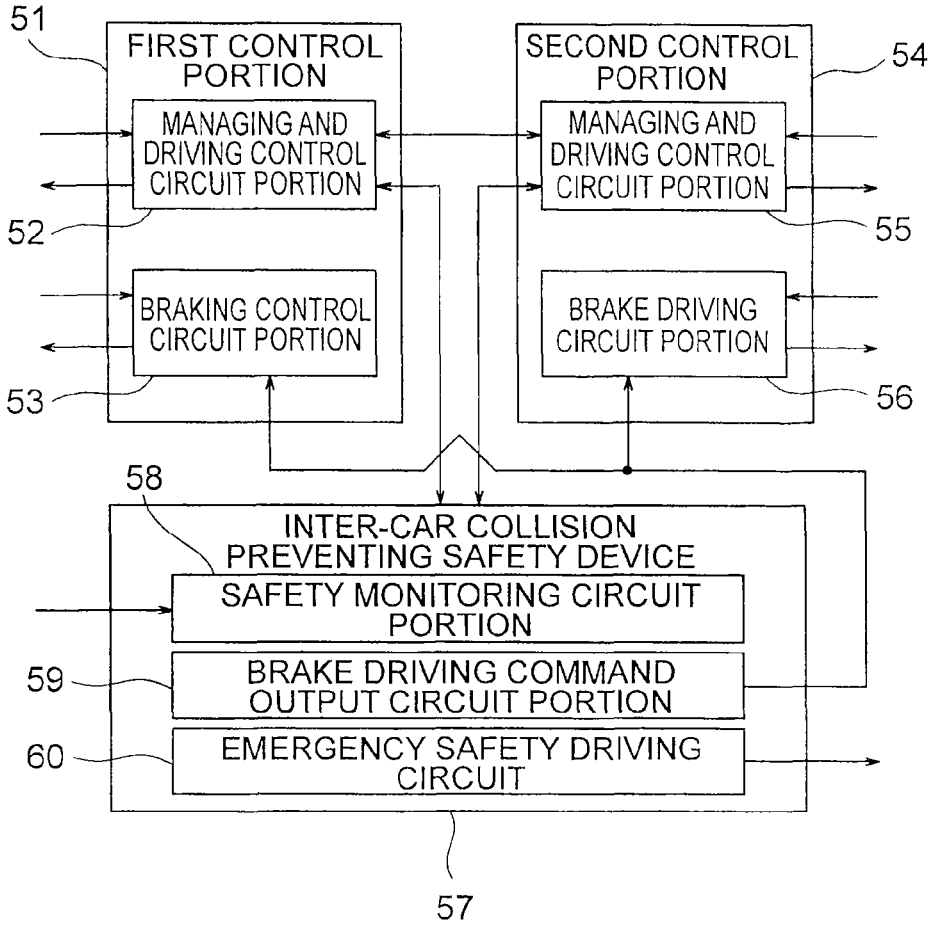
FIG. 2 is a block diagram that shows an elevator control system from FIG. 1.

FIG. 2 is a block diagram that shows an elevator control system from FIG. 1. A first control portion 51 has a first managing and driving control circuit portion 52 and a first brake driving circuit portion 53. The first managing and driving control circuit portion 52 performs running management, velocity control, control of opening and closing of doors, etc., relating to the first car 2. The first brake driving circuit portion 53 drives the first hoisting machine brake 10.

A second control portion 54 has a second managing and driving control circuit portion 55 and a second brake driving circuit portion 56. The second managing and driving control circuit portion 55 performs running management, velocity control, control of opening and closing of doors, etc., relating to the second car 4. The second brake driving circuit portion 56 drives the second hoisting machine brake 12.

An inter-car collision preventing safety device 57 is connected to the first and second control portions 51 and 54. The inter-car collision preventing safety device 57 has a safety monitoring circuit portion 58, a brake driving command output circuit portion 59, and an emergency safety driving circuit 60. The safety monitoring circuit portion 58 monitors for abnormal approaches between the first and second cars 2 and 4 that could lead to collision between the first and second cars 2 and 4.

The brake driving command output circuit portion 59 outputs commands to the first and second control portions 51 and 54 for operating brakes during detection of an abnormal approach between the first and second cars 2 and 4. The emergency safety driving circuit 60 outputs commands to the car speed governor rope gripping apparatus 29 and the counterweight speed governor rope gripping apparatus 34 to grip the speed governor ropes 22 and 32.

Detection signals from the first and second encoders 27 and 28, signals that indicate states of the hoistway switches 39, 40, 41, 43, 44, and 45, and detection signals from the floor alignment sensors 48 and 49 are inputted into the first and second managing and driving control circuit portions 52 and 55.

The managing and driving control circuit portions 52 and 55 detect absolute positions of the first and second cars 2 and 4 inside the hoistway 1 using these input signals. Although not shown in FIG. 1, call signals from passengers, and signals from maintenance workers requesting switching to maintenance operation, etc., are also inputted into the managing and driving control circuit portions 52 and 55.

Velocity command signals for the first hoisting machine 7, and door opening command signals, etc., are outputted from the first managing and driving control circuit portion 52. Similarly, velocity command signals for the second hoisting machine 8, and door opening command signals, etc., are outputted from the second managing and driving control circuit portion 55.

Abnormality detection signals from the inter-car collision preventing safety device 57 and other safety devices (not shown) are inputted into the first and second brake driving circuit portions 53 and 56. The first brake driving circuit portion 53 outputs a command signal to the first hoisting machine 7 to operate the first hoisting machine brake 10 when an abnormality detection signal is received. Similarly, the second brake driving circuit portion 56 outputs a command signal to the second hoisting machine 8 to operate the second hoisting machine brake 12 when an abnormality detection signal is received.

The detection signals from the first and second encoders 27 and 28, the signals that indicate the states of the hoistway switches 39, 40, 41, 43, 44, and 45, and the detection signals from the floor alignment sensors 48 and 49 are inputted into the safety monitoring circuit portion 58. Continuous absolute car positions are detected by detecting discrete absolute car positions using the hoistway switches 39, 40, 41, 43, 44, and 45 and the floor alignment sensors 48 and 49, and interpolating the discrete car position information using the first and second encoders 27 and 28.

The safety monitoring circuit portion 58 detects the velocities of the first and second cars 2 and 4 and the absolute positions of the first and second cars 2 and 4 inside the hoistway 1 using these input signals.

Moreover, the first and second control portions 51 and 54 and the inter-car collision preventing safety device 57 can each be constituted by an independent computer.

Furthermore, in this example, a combination of incremental rotary encoders, hoistway switches, and floor alignment sensors is used in order to detect the absolute positions of the first and second cars 2 and 4 in the managing and driving control circuit portions 52 and 55 and the safety monitoring circuit portion 58, but absolute encoders may be used.

Figure 3:
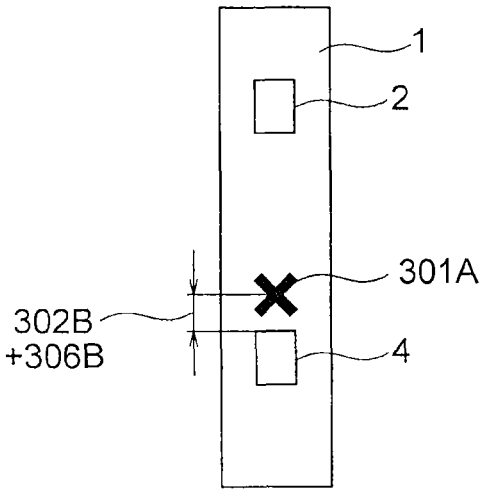
FIG. 3 is an explanatory diagram that shows a first car stopping limit position and a second car exclusion zone from FIG. 1.

Processing in the inter-car collision preventing safety device 57 will be now be demonstrated. FIG. 3 is an explanatory diagram that shows a stopping limit position of the first car 2 and an exclusion zone of the second car 4 from FIG. 1. Stopping limit positions are defined as positions before which it is necessary for the cars 2 and 4 to stop. An exclusion zone is defined as zones that the other car is not permitted to enter, that is set as a distance in which it is possible to undertake a response to stop even if abnormalities arise in both of the cars 2 and 4.

The stopping limit position of the first car 2 is determined as 301A in FIG. 3. The stopping limit position 301A of the first car 2 is determined by calculating an exclusion zone 302B of the second car 4 and an amount of offset 306B from the absolute position and the absolute velocity of the second car 4. Due to the second car 4 moving, this stopping limit position 301A is a quantity that changes continuously with the passage of time, and the sum of the exclusion zone 302B and the amount of offset 306B is also a quantity that changes continuously.

However, the amount of offset 306B may be a fixed value.

The stopping limit position 301 B of the second car 4 is determined from an exclusion zone 302A of the first car 2 that is found from the absolute position and the absolute velocity of the first car 2 and an amount of offset 306A.

Figure 4:
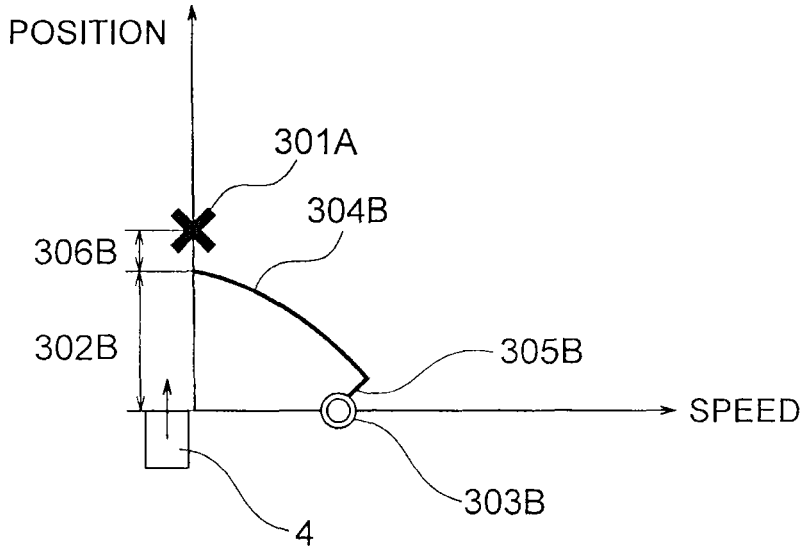
FIG. 4 is a graph that shows an example of a method for determining the exclusion zone in FIG. 3.

Next, details of the method for determining the exclusion zones will be explained. FIG. 4 is a graph that shows an example of a method for determining the exclusion zones in FIG. 3. The exclusion zone of the second car 4 uses a distance that is calculated to enable stopping in response to an emergency safety triggering signal that is outputted at a "given position and speed" that is indicated by 303B in FIG. 4.

In the "given position and speed" 303B, the absolute position of the leading end of the second car 4 near the first car 2 is used as the "given position". The "given speed" is the absolute velocity of the second car 4 toward the first car 2.

Similarly, in the "given position and speed" 303A when determining the exclusion zone of the first car 2, the absolute position of the leading end of the first car 2 near the second car 4 is used as the "given position". The "given speed" is the absolute velocity of the first car 2 toward the second car 4.

Curve 304B in FIG. 4 represents the change in speed of the second car 4 due to the counterweight emergency safety device 35 when an emergency safety triggering signal is outputted at the "given position and speed" 303B. Curve 305B represents an example of a change in state from the "given position and speed" 303B to the curve 304B. The exclusion zone 302B is the distance before the second car 4 in the state of the "given position and speed" 303B stops according to a change in speed such as that indicated by the curve 304B.

Moreover, the exclusion zone is a value that includes actuation time lag of the counterweight emergency safety device 35, and differences in deceleration rates, etc. A position that is advanced from a leading end position in the direction of travel of the second car 4 by an amount that is the sum of the exclusion zone 302B and the amount of offset 306B is designated as the stopping limit position 301A of the first car 2. The amount of offset 306B is a value that is set in order to avoid a kissing state in which the two cars 2 and 4 stop so as to contact each other, and is a numerical value that is greater than 0. The triggering signal that actuates the first car emergency safety device 17 is outputted from the first car speed governor 19.

Figure 5:
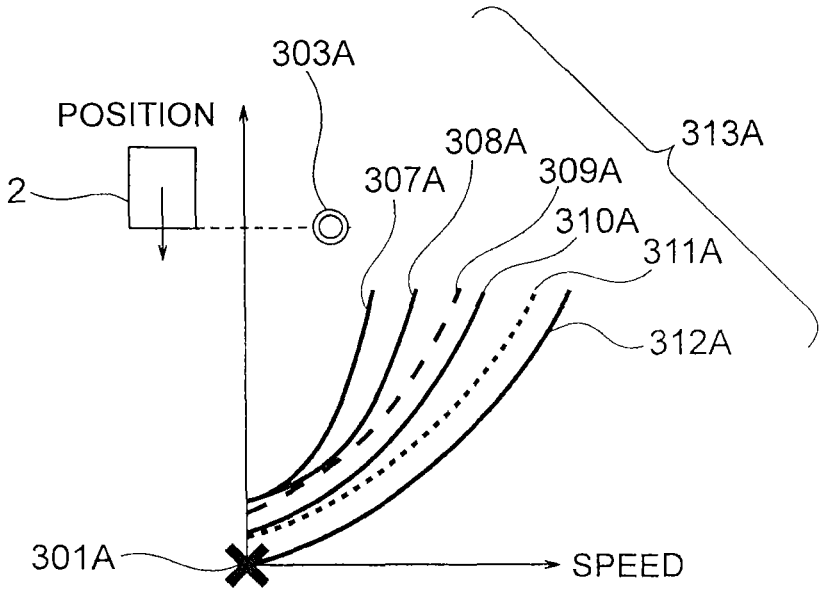
FIG. 5 is a graph that shows a speed pattern that is set in a first control portion, a second control portion, and an inter-car collision preventing safety device to stop the first car in FIG. 3 before the stopping limit position.

Responses by the first control portion 51, the second control portion 54, and the inter-car collision preventing safety device 57 are determined as shown in FIG. 5 such that the first car 2 can decelerate and stop by the stopping limit position 301A of the first car 2 that is determined as described above.

Here, change in speed during normal deceleration, as indicated by curve 307A, and a forced deceleration and abnormal approach detection threshold value that is indicated by the curve 308A are set in the managing and driving control circuit portions 52 and 55. If the first car 2 and the second car 4 approach each other abnormally, then if the inter-car collision preventing safety device 57 detects the abnormality and activates the brake at the abnormal approach detection threshold value that is indicated by the curve 309A, and the change in speed during brake actuation is indicated by the curve 310A, and if the abnormality is detected and the emergency safety is activated at an emergency safety actuation threshold value that is indicated by the curve 311A, the change in speed during emergency safety actuation is indicated by the curve 312A.

Among these curves, the change in speed 312A during emergency safety actuation, which is the change in speed in worst case conditions, is first determined such that the first car 2 can be decelerated and stopped at the stopping limit position 301A by the emergency safety device 17. Next, the emergency safety actuation threshold value 311A is determined as the threshold value for outputting the triggering signal that actuates the emergency safety device 17 so as to follow that change in speed, allowing for actuation lag time, magnitude of slippage of the speed governor rope gripping apparatus 29, and the deceleration rate of the emergency safety device 17, etc.

In addition, the change in speed 310A during brake actuation is determined so as not to intersect with the emergency safety actuation threshold value 311A. Furthermore, the abnormal approach detection threshold value 309A is determined so as to follow such changes in speed, allowing for actuation lag time, distance, and the deceleration rate of the hoisting machine brake 10.

The forced deceleration and abnormal approach detection threshold value 308A in the managing and driving control circuit portion 52 is determined so as not to intersect with the abnormal approach detection threshold value 309A. Lastly, the change in speed during normal deceleration 307A is determined so as to become such a forced deceleration and abnormal approach detection threshold value 308A.

Such curves 307A through 312A relating to the first car 2 are together designated as a first speed pattern 313A. Similarly, curves 307B through 312B relating to the second car 4 are together designated as a second speed pattern 313B. The inter-car collision preventing safety device 57, the first control portion 51, and the second control portion 54 each calculate the speed pattern 313A and the speed pattern 313B.

Figure 6:
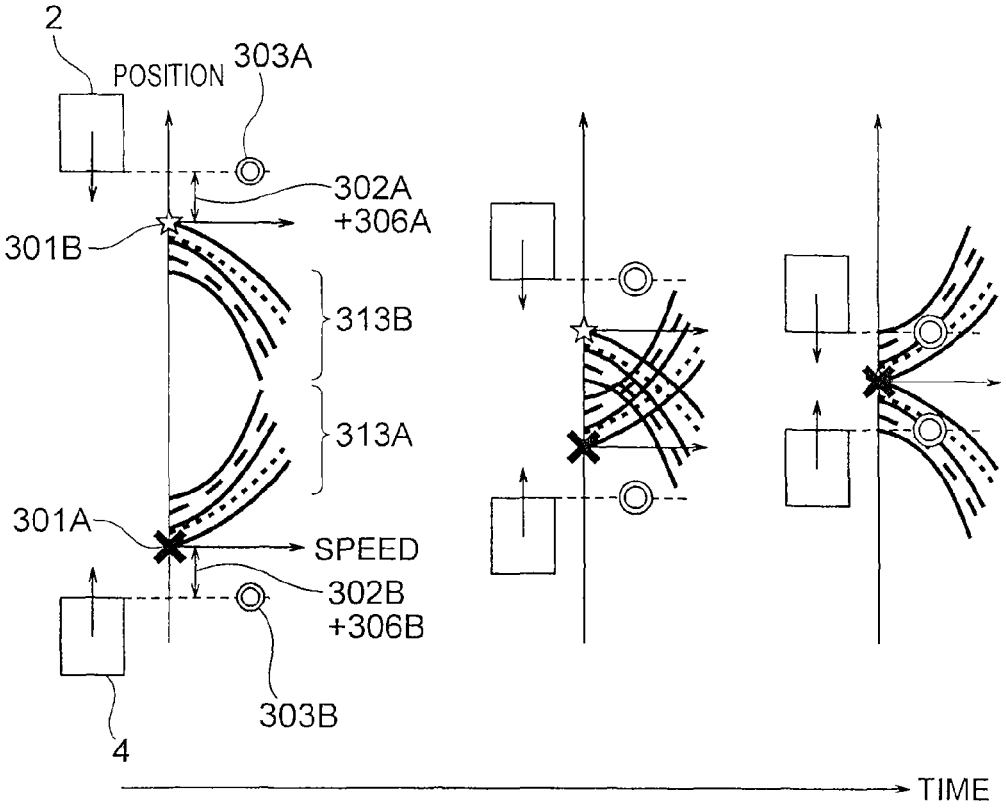
FIG. 6 is a graph that shows time series changes in the first car stopping limit position and the second car stopping limit position and time series changes in a first speed pattern and a second speed pattern that have continuous threshold values for deceleration if an abnormal state is entered from a normal state when two cars move toward each other inside a hoistway.

Time series changes in the stopping limit position 301A of the first car 2 and the stopping limit position 301B of the second car 4 and time series changes in the first speed pattern 313A and a second speed pattern 313B that have continuous threshold values for deceleration if an abnormal state is entered from a normal state when the two cars 2 and 4 move toward each other inside the hoistway 1 are shown in FIG. 6. FIG. 6 shows the position of the cars 2 and 4 on the vertical axis, and shows the speed in the direction in which the first car 2 and the second car 4 approach each other on the horizontal axis.

If the two cars 2 and 4 move toward each other abnormally as time progresses, the stopping limit position 301A of the first car 2 may move toward the first car 2, and the stopping limit position 301B of the second car 4 may move toward the second car 4, depending on the absolute positions and absolute velocities of the cars 2 and 4. Then, the first speed pattern 313A moves closer to the first car 2, and the second speed pattern 313B moves closer to the second car 4, together with that movement of the stopping limit positions.

If the "given position and speed" 303A of the first car 2 exceeds the forced deceleration and abnormal approach detection threshold value 308A, the abnormal approach detection threshold value 309A, or the emergency safety actuation threshold value 311A, which are included in the first speed pattern 313A, then the first car 2 is decelerated and stopped. If the "given position and speed" 303B of the second car 4 exceeds the forced deceleration and abnormal approach detection threshold value 308B, the abnormal approach detection threshold value 309B, or the emergency safety actuation threshold value 311B, which are included in the second speed pattern 313B, then the second car 4 is decelerated and stopped.

Figure 7:
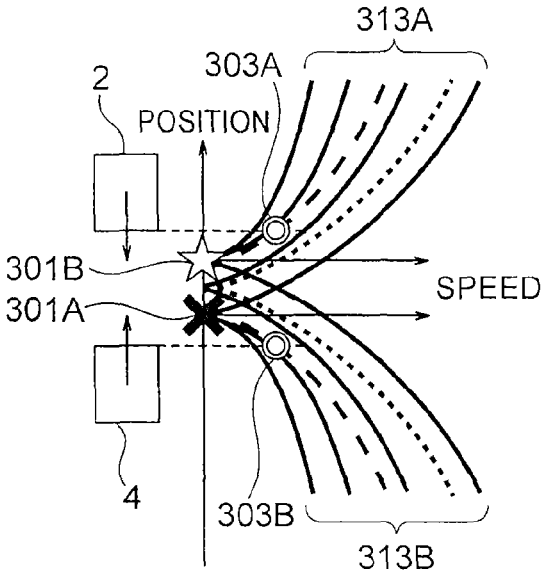
FIG. 7 is a graph that shows an operation that stops the cars using the first and second control portions if the first and second cars approach each other abnormally.

Here, the first and second control portions 51 and 54 respond using the calculated results of the first speed pattern 313A and the second speed pattern 313B, respectively. If approaches toward the second car 4 and toward the first car 2, respectively, are determined to be abnormal using the abnormal approach detection threshold value 308A and the abnormal approach detection threshold value 308B, respectively, as in FIG. 7, then the cars 2 and 4 are forcibly decelerated by the managing and driving control circuit portions 52 and 55, and are stopped before collision.

Moreover, instead of calculating the speed patterns 313A and 313B in the first control portion 51 and the second control portion 54, the inter-car collision preventing safety device 57 may detect that the threshold values have been exceeded, and issue deceleration commands to the control portions 51 and 54.

The following response may also be made instead of calculating the speed patterns 313A and 313B in the first control portion 51 and the second control portion 54. First, the change in speed during normal deceleration 307A and the forced deceleration and abnormal approach detection threshold value 308A are calculated in the first control portion 51, and if they approach each other abnormally, then the first car 2 is decelerated. The change in speed during normal deceleration 307B and the forced deceleration and abnormal approach detection threshold value 308B are also calculated in the second control portion 54, and the second car 4 is decelerated if an abnormal approach is detected. If the cars 2 and 4 still approach each other abnormally, the abnormal approach detection threshold values 309A and 309B are calculated in the inter-car collision preventing safety device 57, and the brakes are operated if these threshold values are exceeded. If the cars 2 and 4 still approach each other abnormally, the emergency safety actuation threshold values 311A and 311B are calculated in the inter-car collision preventing safety device 57, and the emergency safeties are operated if these threshold values are exceeded.

Figure 8:
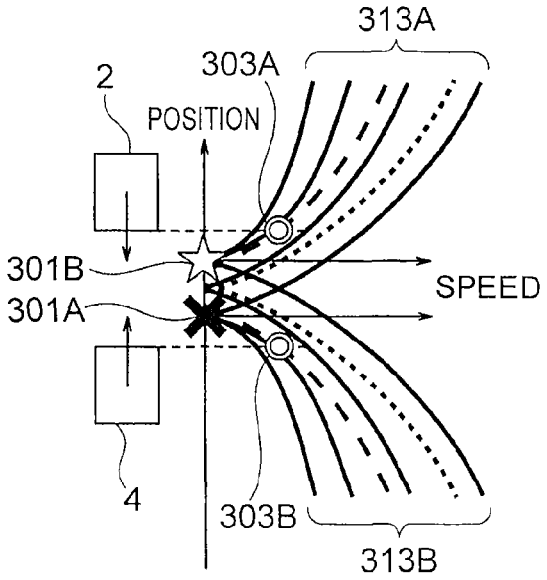
FIG. 8 is a graph that shows an operation when the first and second cars further approach each other abnormally from the state in FIG. 7.

If the cars 2 and 4 still move toward each other, the inter-car collision preventing safety device 57 responds using the calculated results of the speed patterns 313A and 313B. If the abnormal approach detection threshold values 309A and 309B are exceeded, as in FIG. 8, then it is determined to be abnormal, and the cars 2 and 4 are decelerated according to the changes in speed during brake actuation 310A and 310B.

Figure 9:
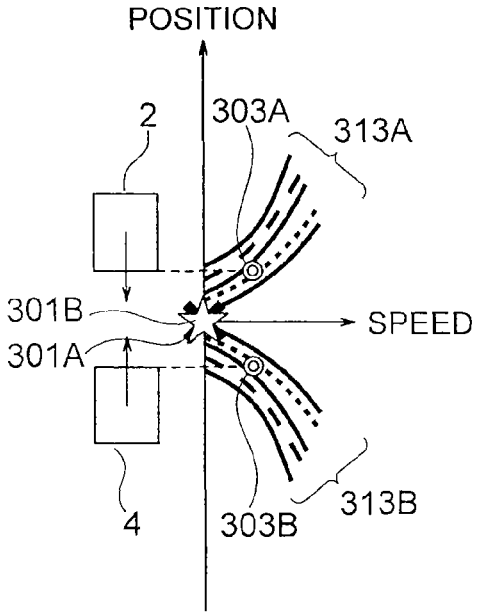
FIG. 9 is a graph that shows an operation when the first and second cars further approach each other abnormally from the state in FIG. 8.

If an abnormality still remains, and the cars 2 and 4 move even closer toward each other, and the emergency safety actuation threshold values 311A and 311 B are exceeded, as in FIG. 9, then it is determine to be even more abnormal, and the cars 2 and 4 are decelerated according to the changes in speed during emergency safety actuation 312A and 312B.

Figure 10:
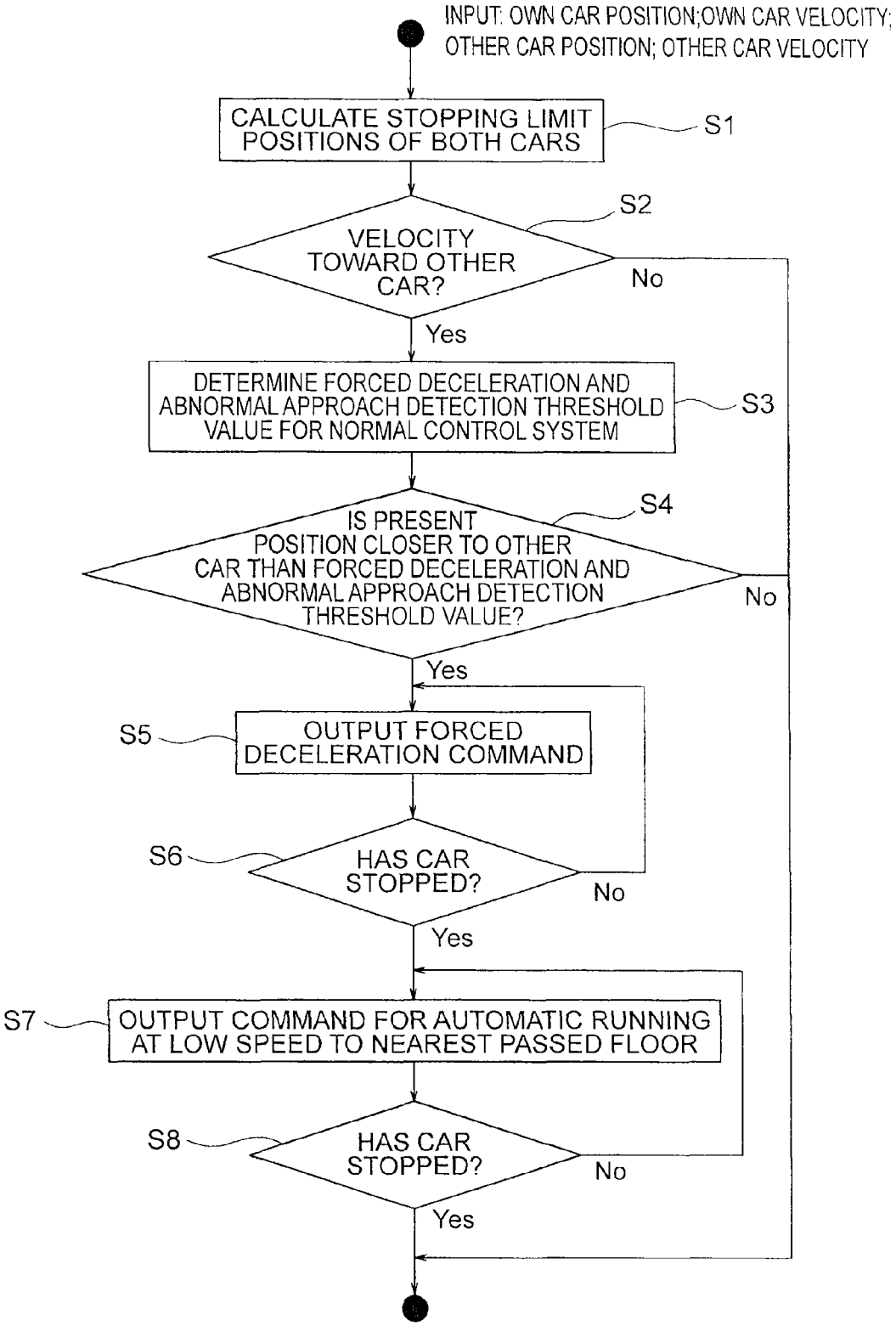
FIG. 10 is a flowchart that shows a car approach monitoring operation of first and second managing and driving control circuit portions from FIG. 2.
Figure 11:
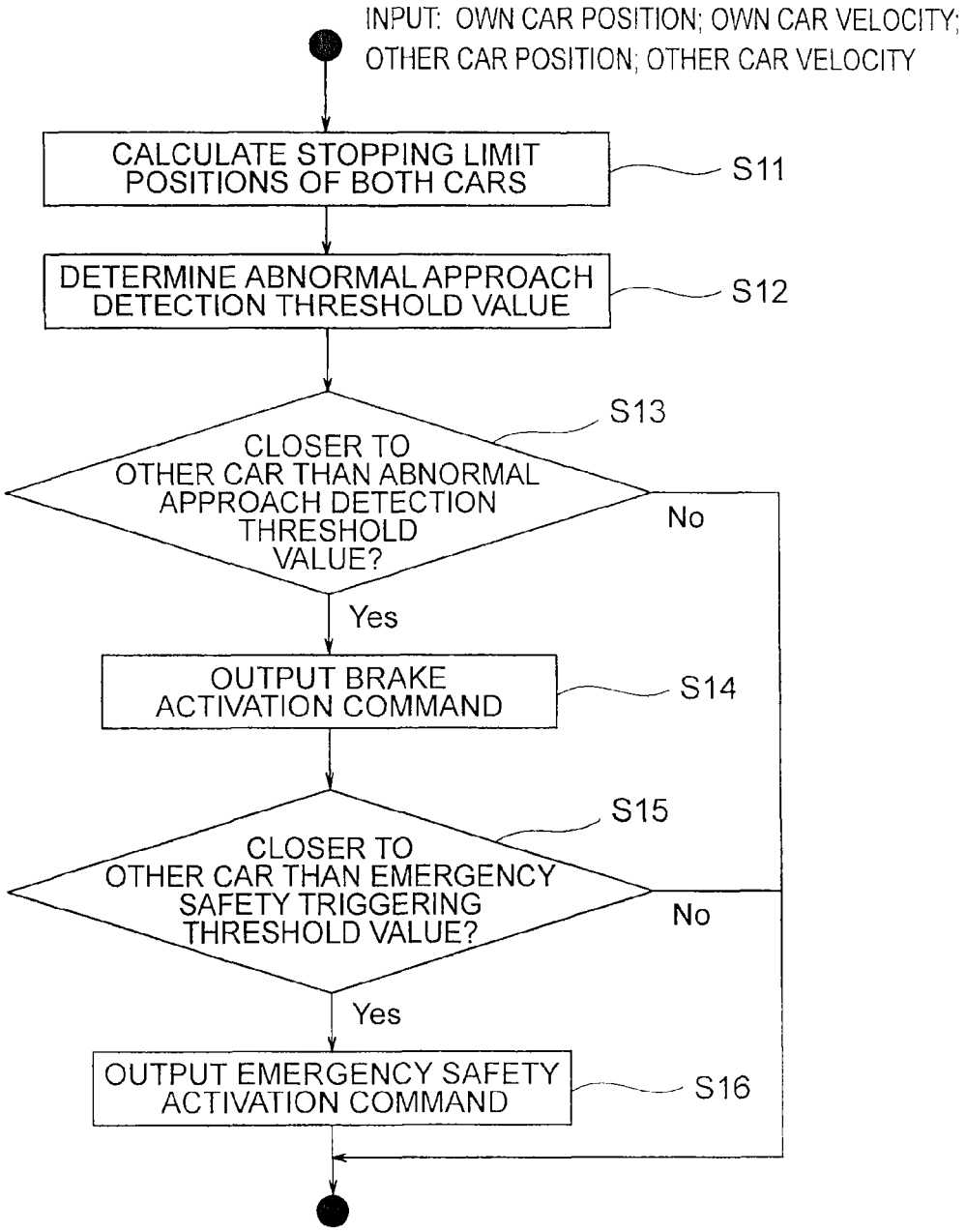
FIG. 11 is a flowchart that shows a car approach monitoring operation of the inter-car collision preventing safety device from FIG. 2.

To summarize the responses when there is an abnormality, FIG. 10 is the response flow in the managing and driving control circuit portions 52 and 55, and FIG. 11 is the response flow when the cars 2 and 4 still approach each other abnormally.

FIG. 10 is a flowchart that shows a car approach monitoring operation of the first and second managing and driving control circuit portions 52 and 55 from FIG. 2. The managing and driving control circuit portions 52 and 55 execute the processing in FIG. 10 repeatedly at a predetermined period. In a car approach monitoring operation of the managing and driving control circuit portions 52 and 55, the stopping limit positions of the two cars 2 and 4 are first calculated (Step S1). Next, it is determined whether or not there is velocity toward the other car (Step S2). If the velocity is not toward the other car, then that iteration of processing is terminated.

If the velocity is toward the other car, a forced deceleration and abnormal approach detection threshold value using the normal control system is determined (Step S3). Then it is determined whether or not the present position is closer to the other car than the forced deceleration and abnormal approach detection threshold value (Step S4). If the present position is not closer to the other car than the forced deceleration and abnormal approach detection threshold value, then that iteration of processing is terminated.

If the present position is closer to the other car than the forced deceleration and abnormal approach detection threshold value, then a forced deceleration command is outputted (Step S5), and it is determined whether or not the cars 2 and 4 have stopped (Step S6). After that, a command for automatic running at low speed to the nearest passed floor is outputted (Step S7). In other words, entrapment of passengers inside the cars 2 and 4 is prevented by moving the cars 2 and 4 to the nearest floors such that the cars 2 and 4 move further apart. Then, after the cars 2 and 4 have stopped (Step S8), processing is terminated.

FIG. 11 is a flowchart that shows a car approach monitoring operation of the inter-car collision preventing safety device 57 from FIG. 2. The inter-car collision preventing safety device 57 executes the processing in FIG. 11 repeatedly at a predetermined period. In a car approach monitoring operation of the inter-car collision preventing safety device 57, the stopping limit positions of the two cars 2 and 4 are first calculated (Step S11). Next, abnormal approach detection threshold values are determined (Step S12).

Next, it is determined whether or not the present position is closer to the other car than the abnormal approach detection threshold value (Step S13). If the present position is not closer to the other car than the abnormal approach detection threshold value, then that iteration of processing is terminated. If the present position is closer to the other car than the abnormal approach detection threshold value, a brake activation command is outputted (Step S14). Next, it is determined whether or not the present position is closer to the other car than an emergency safety triggering threshold value (Step S15). If the present position is closer to the other car than the emergency safety triggering threshold value, an emergency safety activation command is outputted (Step S16).

Moreover, the response in FIG. 10 and the response in FIG. 11 are independent from each other, and the operation of the inter-car collision preventing safety device 57 is not affected by the managing and driving control circuit portions 52 and 55.

Using a technique such as that described above, if any abnormality arises and the first car 2 and the second car 4 approach each other, that abnormality can be detected from the absolute positions and absolute velocities of the first car 2 and the second car 4, and the cars 2 and 4 can be decelerated and stopped by the managing and driving control circuit portions 52 and 55 and the inter-car collision preventing safety device 57.

Figure 12:
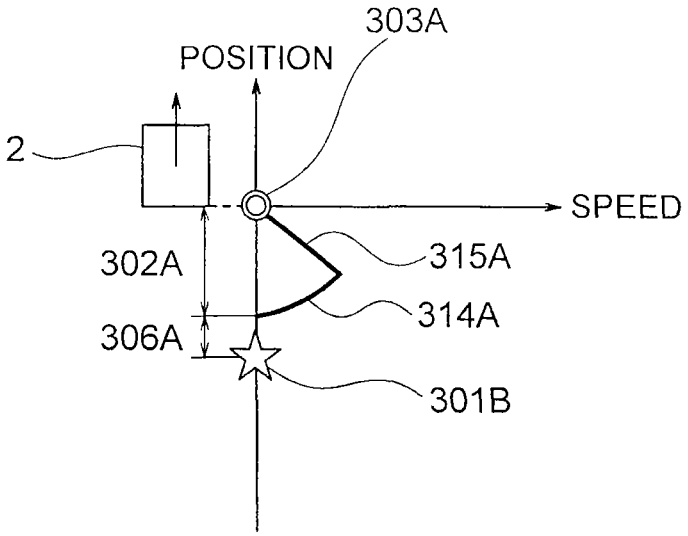
FIG. 12 is a graph that shows a method for determining the second car stopping limit position if the first car has stopped or is traveling away from the second car.

Next, if an abnormality occurs when the first car has stopped or is traveling away from the second car, if it is deemed that the first car 2 and the second car 4 are approaching each other abnormally, the first car 2 will be stopped momentarily from the direction of travel, and moved in the opposite direction. Because of that, the "given position and speed" 303A is determined on the assumption that the speed of the first car 2 in the opposite direction to the direction of travel is 0, as shown in FIG. 12. Here, the change in speed due to the emergency safety device 17 when an emergency safety triggering signal is outputted at the "given position and speed" 303A is represented by curve 314A. Curve 315B represents an example of a change in state from the "given position and speed" 303B to curve 314B.

Moreover, an equivalent method is also used when determining the stopping limit position 301A of the first car 2 relative to a second car 4 that is traveling downward.

After determining the stopping limit position 301B of the second car 4, the methods for performing detection of an abnormal approach, decelerating and stopping are similar or identical to those of Embodiment 1. After determining the stopping limit position of the first car 2, the methods for performing detection of an abnormal approach, decelerating and stopping are also similar or identical to those of Embodiment 1.

There are three directions of movement of the first car 2, i.e., upward, stopped, and downward. There are also three directions of movement of the second car 4, i.e., upward, stopped, and downward. Consequently, there are nine combinations of the directions of movement of the two cars 2 and 4, i.e., three times three. All of these nine combinations can be handled by any of the above methods, and the responses in the managing and driving control circuit portions 52 and 55 or the responses in the inter-car collision preventing safety device 57 can be achieved using an identical algorithm.

Here, if incremental rotary encoders are used in order to measure the absolute velocities and the absolute positions of the cars 2 and 4, then it is necessary to determine initial positions during installation or during power-up. Because of that, a learning run is required in order to determine the initial positions.

When two cars 2 and 4 ascend and descend through a hoistway 1, learning of initial positions may be performed using upper portion hoistway switches 39 and 40 for a first car 2 that is installed in an upper portion inside the hoistway 1, and lower portion hoistway switches 43 and 44 for a second car 4 that is installed in a lower portion inside the hoistway 1. During a learning run of this kind, the inter-car collision preventing safety device 57 determines that there is an abnormality if the first car is detected proceeding toward the second car, and similarly determines that there is an abnormality if the second car is detected proceeding toward the first car, and stops the cars 2 and 4.

Alternatively, the second car 4 may be lowered first, and the lower portion hoistway switches 43 and 44 used to perform the learning of the initial positions, and then the first car 2 raised, and the upper portion hoistway switches 39 and 40 used to perform the learning of the initial positions. Here, the inter-car collision preventing safety device 57 determines that there is an abnormality if the first car is detected proceeding toward the second car during the learning run of the second car 4, and similarly determines that there is an abnormality if the second car is detected proceeding toward the first car during the learning run of the first car 2, and stops the cars 2 and 4.

Furthermore, the second car 4 may be lowered first, and the lower portion hoistway switches 43 and 44 used to perform the learning of the initial positions, and then the first car 2 lowered, and the lower portion service floor switch 41 used to perform the learning of the initial positions. Alternatively, the first car 2 may be raised first, and the upper portion hoistway switches 39 and 40 used to perform the learning of the initial positions, and then the second car 4 raised, and the upper portion service floor switch 45 used to perform the learning of the initial positions. Thus, the method of the learning run can be selected from various methods depending on the layout of the hoistway switches.

Moreover, if three or more cars ascend and descend through the hoistway 1, then each of the cars can be numbered in order from below in advance, and learning by all of the cars can be performed by lowering the cars sequentially starting from the lowest car, and after learning by the lowest car is completed, performing learning by the next lowest car, etc.

Furthermore, instead of learning from the lowest, it is also possible to learn sequentially by raising the cars from the highest car.

In addition, in order to shorten learning time, an upper half of the total number of the cars may perform learning from the highest car, and a lower half of the total number of the cars may perform learning from the lowest car.

According to a multi-car elevator of this kind, deceleration and stopping that can avoid collision can be achieved even if a leading car stops suddenly when first and second cars 2 and 4 are traveling in identical directions.

Since responses that prevent collision can be decided automatically when an abnormality occurs in a comparatively short inter-car distance, the occurrence of car deceleration, which degrades serviceability, is maximally prevented while enabling collisions between the cars 2 and 4 to be prevented.

In addition, by combining incremental rotary encoders and learning runs during power-up instead of expensive absolute position sensors, a comparatively inexpensive system configuration is achieved.

Embodiment 2

Next, Embodiment 2 of the present invention will be explained. In Embodiment 1, the inter-car collision preventing safety device 57, the first control portion 51, and the second control portion 54 each calculate the speed patterns 313A and 313B. In contrast to that, in Embodiment 2, one of the control portions, in this case, the second control portion 54, does not calculate the speed patterns. If an abnormal approach is detected by the other control portion, in this case, the first control portion 51, the second control portion 54 adopts an identical response simultaneously with the response by the first control portion 51. The response by the inter-car collision preventing safety device 57 is also performed on the two cars simultaneously. Collision between the first and second cars 2 and 4 can be prevented thereby.

Collision can also be prevented if only the inter-car collision preventing safety device 57 has speed patterns 313A and 313B, by issuing commands for response by the managing and driving control circuit portions 52 and 55 and the inter-car collision preventing safety device 57 when there is an abnormal approach.

Rewriting of software and load on hardware, etc., can be reduced by computing the speed patterns 313A and 313B using only one portion among the inter-car collision preventing safety device 57, the first control portion 51, and the second control portion 54 in this manner, that is, by reducing the apparatuses that perform calculation of the speed patterns 313A and 313B.

Embodiment 3

Next, Embodiment 3 of the present invention will be explained. In Embodiment 3, the inter-car collision preventing methods according to Embodiments 1 and 2 are used in a terminal floor forced deceleration apparatus by regarding a terminal portion of a hoistway 1 as another car that has stopped. In other words, the sensor configurations and programs in the inter-car collision preventing method are expanded to also cover a collision preventing safety system in a hoistway terminal portion.

By using the inter-car collision preventing method in a terminal floor forced deceleration apparatus in this manner, sensor configurations and programs for inter-car collision prevention and sensor configurations and programs for collision prevention in the hoistway terminal portion are standardized, enabling the configuration to be simplified.

In a terminal floor forced deceleration apparatus of this kind, an excessive speed detection level that changes depending on car position, that is, an excessive speed detection level that becomes continuously smaller toward the hoistway terminal portions inside car deceleration zones of the hoistway terminal portions, can be set. In addition, a program for inter-car collision prevention can easily be produced using programs that have been developed for conventional terminal floor forced deceleration apparatuses.

Moreover, it is not necessary to decelerate a car due to an abnormal approach while avoiding a collision in a small exclusion zone, enabling reductions in service to be prevented. However, it is also conceivable that there may be cases in which a configuration is required that makes allowance for a car to stop if there is an abnormal approach at one end. Here, as shown in FIG. 13, for example, an exclusion zone plus an amount of offset may be set as a distance in which it is possible to output an emergency safety triggering signal so as to enable stopping by the counterweight emergency safety device if there is still an abnormality after decelerating using the brakes based on the absolute position and absolute velocity of the other car.

Figure 14:
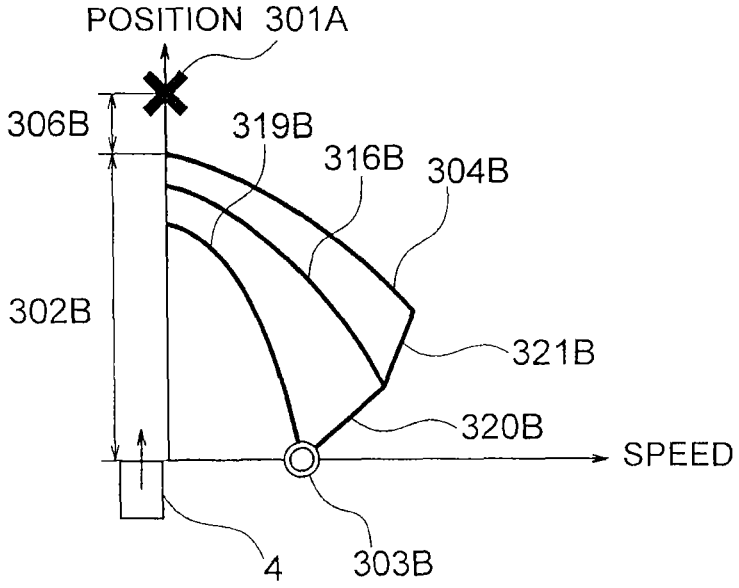
FIG. 14 is a graph that shows yet another example of a method for determining the exclusion zone.

Alternatively, as shown in FIG. 14, an exclusion zone plus an amount of offset may be set as a distance in which it is possible to output an emergency safety triggering signal so as to enable stopping by the counterweight emergency safety device if there is still an abnormality after decelerating immediately based on the absolute position and absolute velocity of the other car, and if then there is still an abnormality after decelerating using the brakes.

Figure 13:
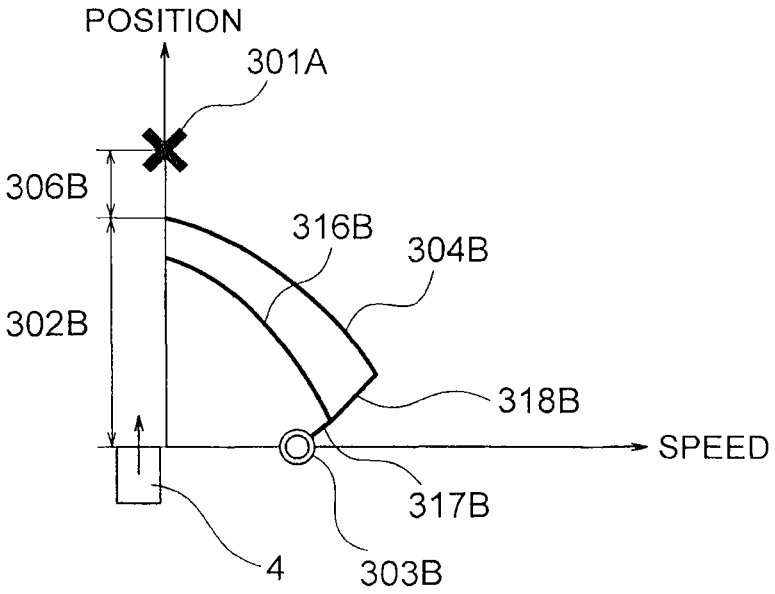
FIG. 13 is a graph that shows another example of a method for determining the exclusion zone.

In FIG. 13, curve 317B represents an example of a change in state from a "given position and speed" 303B to a change in speed during brake actuation 316B. If there is still an abnormality in that state, an emergency safety device triggering signal is outputted, and an example of a change in speed of the second car 4 due to the counterweight emergency safety device 35 until curve 304B is represented by curve 318B.

In FIG. 14, there is a control system deceleration curve 319B from a "given position and speed" 303B, and curve 320B represents an example when there is an abnormality that cannot be handled by that control system deceleration curve 319B until a change in speed during brake actuation 316B. If there is still an abnormality in that state, an emergency safety device triggering signal is outputted, and an example of a change in speed of the second car 4 due to the counterweight emergency safety device 35 until curve 304B is represented by curve 321 B.

In addition, the exclusion zone may be determined using consecutive calculations as in methods such as those in FIGS. 4, 13, and 14, but a table memory that has been determined in advance may be used as a reference. Alternatively, a fixed value that uses a maximum acceptable value may be used as the exclusion zone.

Furthermore, in the above examples, two cars 2 and 4 are disposed inside a shared hoistway 1, but the elevator may be an elevator in which three or more cars are disposed.

The roping method and the layout of the equipment (the hoisting machines, the counterweight, sensors, etc.) relating to each of the cars is not limited to the configuration in FIG. 1.

In addition, the braking apparatus is not limited to the hoisting machine brakes 10 and 12, and may be car brakes that are mounted onto the cars 2 and 4, or rope brakes that grip the suspending bodies 14 and 16, for example.

The invention claimed is:

1. A multi-car elevator comprising:

a plurality of cars that are disposed inside a shared hoistway;

a plurality of controllers that control operation of corresponding cars; and an inter-car collision preventing safety device that is connected to the controllers, and that monitors for an abnormal approach between the cars, wherein, if two vertically adjacent cars among the cars are designated first and second cars, then:

a zone that is a distance in which the second car can be stopped in response to an absolute velocity of the second car for an abnormality, and into which the first car is not permitted to enter is set as an exclusion zone of the second car;

an absolute position that is advanced by a distance that is greater than or equal to the exclusion zone in a direction of the first car from an absolute position at a leading end of the second car in the direction of the first car is set as a stopping limit position of the first car;

a plurality of threshold values that progressively detect the abnormal approach are set so as to enable the first car to decelerate and stop before the stopping limit position of the first car; and if the second car has an absolute velocity in a direction away from the first car, then the exclusion zone of the second car is set, and the stopping limit position of the first car is set by utilizing a speed towards the first car which is zero.

2. The multi-car elevator according to claim 1, wherein the threshold values are respectively set so as to correspond to a change in speed during normal deceleration, a change in speed during operation of a braking apparatus, and a change in speed during operation of an emergency safety device.

3. The multi-car elevator according to claim 1, wherein, among the cars, collision into a terminal portion of the hoistway by a car that is positioned near the terminal portion of the hoistway is prevented by a method that is similar or identical to collision prevention between the cars by regarding the terminal portion of the hoistway as a car that has stopped.

4. A multi-car elevator comprising:

a plurality of cars that are disposed inside a shared hoistway;

a plurality of controllers that control operation of corresponding cars; and an inter-car collision preventing safety device that is connected to the controllers, and that monitors for an abnormal approach between the cars, wherein, if two vertically adjacent cars among the cars are designated first and second cars, then:

a zone that is a distance in which the second car can be stopped in response to an absolute velocity of the second car for an abnormality, and into which the first car is not permitted to enter is set as an exclusion zone of the second car;

an absolute position that is advanced by a distance that is greater than or equal to the exclusion zone of the second car in a direction of the first car from an absolute position at a leading end of the second car in the direction of the first car is set as a stopping limit position of the first car;

a plurality of threshold values that progressively detect the abnormal approach are set so as to enable the first car to decelerate and stop before the stopping limit position of the first car;

a zone that is a distance in which the first car can be stopped in response to an absolute velocity of the first car for an abnormality, and into which the second car is not permitted to enter is set as an exclusion zone of the first car;

an absolute position that is advanced by a distance that is greater than or equal to the exclusion zone of the first car in a direction of the second car from an absolute position at a leading end of the first car in the direction of the second car is set as a stopping limit position of the second car; and a plurality of threshold values that progressively detect the abnormal approach are set so as to enable the second car to decelerate and stop before the stopping limit position of the second car.

5. A multi-car elevator comprising:

a plurality of cars that are disposed inside a shared hoistway;

a plurality of controllers that control operation of corresponding cars; and an inter-car collision preventing safety device that is connected to the controllers, and that monitors for an abnormal approach between the cars, wherein, if two vertically adjacent cars among the cars are designated first and second cars, then:

a zone that is a distance in which the second car can be stopped in response to an absolute velocity of the second car for an abnormality, and into which the first car is not permitted to enter is set as an exclusion zone of the second car;

an absolute position that is advanced by a distance that is greater than or equal to the exclusion zone of the second car in a direction of the first car from an absolute position at a leading end of the second car in the direction of the first car is set as a stopping limit position of the first car;

a plurality of threshold values that progressively detect the abnormal approach are set so as to enable the first car to decelerate and stop before the stopping limit position of the first car; and if it is detected that the first car approaches the second car abnormally, the controllers utilize identical responses for the first and second cars.

* * * * *